US010211538B2

(12) United States Patent
Honkanen et al.

(10) Patent No.: US 10,211,538 B2
(45) Date of Patent: Feb. 19, 2019

(54) DIRECTIONAL ANTENNA APPARATUS AND METHODS

(71) Applicant: PULSE FINLAND OY, Oulunsalo (FI)

(72) Inventors: Kimmo Honkanen, Oulu (FI); Kimmo Koskiniemi, Oulu (FI); Petteri Annamaa, Oulunsalo (FI)

(73) Assignee: PULSE FINLAND OY, Oulunsalo (FI)

( * ) Notice: Subject to any disclaimer, the term of this patent is extended or adjusted under 35 U.S.C. 154(b) by 279 days.

(21) Appl. No.: 15/083,869

(22) Filed: Mar. 29, 2016

(65) Prior Publication Data

US 2017/0214146 A1 Jul. 27, 2017

Related U.S. Application Data

(60) Provisional application No. 62/141,711, filed on Apr. 1, 2015.

(51) Int. Cl.
*H01Q 1/38* (2006.01)
*H01Q 15/14* (2006.01)
(Continued)

(52) U.S. Cl.
CPC ..... *H01Q 15/14* (2013.01); *H01Q 1/2283* (2013.01); *H01Q 1/243* (2013.01); *H01Q 1/38* (2013.01);
(Continued)

(58) Field of Classification Search
CPC ..... H01Q 15/14; H01Q 1/243; H01Q 1/38; H01Q 1/48; H01Q 21/28
(Continued)

(56) References Cited

U.S. PATENT DOCUMENTS 4,069,483 A 1/1978 Kaloi
4,401,988 A 8/1983 Kaloi
(Continued)

FOREIGN PATENT DOCUMENTS

DE 10150149 A1 4/2003
EP 0332139 A2 9/1989
(Continued)

OTHER PUBLICATIONS

Elsallal, et al., "A Novel Approach of a Planar Multi-Band Hybrid Series Feed Network for Use in Antenna Systems Operating at Millimeter Wave Frequencies," pp. 15-24, Rockwell Collins, Inc.
(Continued)

*Primary Examiner* — Andrea Lindgren Baltzell
(74) *Attorney, Agent, or Firm* — Gazdzinski & Associates, PC

(57) ABSTRACT

Directional antenna apparatus and methods of utilizing the same. In one embodiment, the directional antenna apparatus includes a chip component disposed on a ground plane. The chip component includes a conductive layer disposed upon a ceramic substrate. The conductive layer of the chip component is connected to electronic circuitry via one or more feed structures and one or more ground structures. The chip component and the ground plane are disposed atop a reflector component in a substantially orthogonal orientation. By spacing the ground plane from the reflector component by a set amount, the directional nature of the directional antenna apparatus may be configured.

20 Claims, 8 Drawing Sheets

(51) Int. Cl.

| | |
|---|---|
| ***H01Q 1/48*** | (2006.01) |
| ***H01Q 1/22*** | (2006.01) |
| ***H01Q 21/28*** | (2006.01) |
| *H01Q 1/24* | (2006.01) |

(52) U.S. Cl.
CPC ..... *H01Q 1/48* (2013.01); *H01Q 21/28* (2013.01); *H01Q 1/242* (2013.01)

(58) Field of Classification Search
USPC ..... 343/912
See application file for complete search history.

(56) References Cited

U.S. PATENT DOCUMENTS

| | | | |
|---|---|---|---|
| 4,977,383 | A | 12/1990 | Niiranen |
| 5,001,492 | A | 3/1991 | Shapiro et al. |
| 5,047,739 | A | 9/1991 | Kuokkanen |
| 5,103,197 | A | 4/1992 | Turunen et al. |
| 5,157,363 | A | 10/1992 | Puurunen et al. |
| 5,159,303 | A | 10/1992 | Flink |
| 5,210,510 | A | 5/1993 | Karsikas |
| 5,239,279 | A | 8/1993 | Turunen et al. |
| 5,278,528 | A | 1/1994 | Turunen |
| 5,281,326 | A | 1/1994 | Galla |
| 5,298,873 | A | 3/1994 | Ala-Kojola |
| 5,302,924 | A | 4/1994 | Jantunen et al. |
| 5,304,968 | A | 4/1994 | Ohtonen et al. |
| 5,307,036 | A | 4/1994 | Turunen et al. |
| 5,319,328 | A | 6/1994 | Turunen |
| 5,349,315 | A | 9/1994 | Ala-Kojola |
| 5,349,700 | A | 9/1994 | Parker |
| 5,351,023 | A | 9/1994 | Niiranen |
| 5,354,463 | A | 10/1994 | Turunen et al. |
| 5,382,959 | A | 1/1995 | Pett et al. |
| 5,386,214 | A | 1/1995 | Sugawara |
| 5,387,886 | A | 2/1995 | Takalo et al. |
| RE34,898 | E | 4/1995 | Turunen |
| 5,408,206 | A | 4/1995 | Turunen et al. |
| 5,418,508 | A | 5/1995 | Puurunen |
| 5,432,489 | A | 7/1995 | Yrjoelae |
| 5,467,065 | A | 11/1995 | Turunen et al. |
| 5,473,295 | A | 12/1995 | Turunen |
| 5,506,554 | A | 4/1996 | Ala-Kojola |
| 5,508,668 | A | 4/1996 | Prokkola |
| 5,521,561 | A | 5/1996 | Yrjoelae et al. |
| 5,541,560 | A | 7/1996 | Turunen et al. |
| 5,543,764 | A | 8/1996 | Turunen et al. |
| 5,550,519 | A | 8/1996 | Korpela |
| 5,557,292 | A | 9/1996 | Nygren et al. |
| 5,570,071 | A | 10/1996 | Ervasti |
| 5,585,771 | A | 12/1996 | Ervasti et al. |
| 5,594,395 | A | 1/1997 | Niiranen |
| 5,604,471 | A | 2/1997 | Rattile et al. |
| 5,627,502 | A | 5/1997 | Ervasti |
| 5,675,301 | A | 10/1997 | Naeppae et al. |
| 5,689,221 | A | 11/1997 | Niiranen et al. |
| 5,717,368 | A | 2/1998 | Niiranen |
| 5,731,749 | A | 3/1998 | Yrjoelae et al. |
| 5,734,305 | A | 3/1998 | Ervasti |
| 5,734,351 | A | 3/1998 | Ojantakanen et al. |
| 5,739,735 | A | 4/1998 | Pyykkoe et al. |
| 5,742,259 | A | 4/1998 | Annamaa |
| 5,764,190 | A | 6/1998 | Murch et al. |
| 5,793,269 | A | 8/1998 | Ervasti et al. |
| 5,815,048 | A | 9/1998 | Ala-Kojola et al. |
| 5,892,490 | A | 4/1999 | Asakura et al. |
| 5,903,820 | A | 5/1999 | Hagstroem |
| 5,905,475 | A | 5/1999 | Annamaa |
| 5,926,139 | A | 7/1999 | Korisch |
| 5,990,848 | A | 11/1999 | Annamaa et al. |
| 6,014,106 | A | 1/2000 | Annamaa |
| 6,016,130 | A | 1/2000 | Annamaa |
| 6,023,608 | A | 2/2000 | Yrjoelae et al. |
| 6,037,848 | A | 3/2000 | Alila et al. |
| 6,078,231 | A | 6/2000 | Pelkonen |
| 6,097,345 | A | 8/2000 | Walton |
| 6,133,879 | A | 10/2000 | Grangeat et al. |
| 6,140,973 | A | 10/2000 | Annamaa et al. |
| 6,147,650 | A | 11/2000 | Kawahata et al. |
| 6,157,819 | A | 12/2000 | Vuokko et al. |
| 6,177,908 | B1 | 1/2001 | Kawahata et al. |
| 6,185,434 | B1 | 2/2001 | Hagstroem et al. |
| 6,195,049 | B1 | 2/2001 | Kim et al. |
| 6,215,376 | B1 | 4/2001 | Hagstroem et al. |
| 6,246,368 | B1 | 6/2001 | Deming et al. |
| 6,252,554 | B1 | 6/2001 | Isohätälä et al. |
| 6,268,831 | B1 | 7/2001 | Sanford |
| 6,316,975 | B1 | 11/2001 | O'Toole et al. |
| 6,323,811 | B1 | 11/2001 | Tsubaki et al. |
| 6,326,921 | B1 | 12/2001 | Egorov et al. |
| 6,384,785 | B1 | 5/2002 | Kamogawa et al. |
| 6,404,394 | B1 | 6/2002 | Hill |
| 6,473,056 | B2 | 10/2002 | Annamaa |
| 6,549,167 | B1 | 4/2003 | Yoon |
| 6,606,016 | B2 | 8/2003 | Takamine |
| 6,614,400 | B2 | 9/2003 | Egorov |
| 6,650,295 | B2 | 11/2003 | Ollikainen et al. |
| 6,683,573 | B2 | 1/2004 | Park |
| 6,781,545 | B2 | 8/2004 | Sung |
| 6,847,329 | B2 | 1/2005 | Ikegaya et al. |
| 6,862,441 | B2 | 3/2005 | Ella et al. |
| 6,876,329 | B2 | 4/2005 | Milosavljevic |
| 6,950,066 | B2 | 9/2005 | Hendler et al. |
| 7,042,403 | B2 | 5/2006 | Colburn et al. |
| 7,057,560 | B2 | 6/2006 | Erkocevic |
| 7,081,857 | B2 | 7/2006 | Kinnunen et al. |
| 7,099,690 | B2 | 8/2006 | Milosavljevic |
| 7,126,546 | B2 | 10/2006 | Annamaa et al. |
| 7,136,019 | B2 | 11/2006 | Mikkola et al. |
| 7,142,824 | B2 | 11/2006 | Kojima et al. |
| 7,148,849 | B2 | 12/2006 | Lin |
| 7,148,851 | B2 | 12/2006 | Takaki et al. |
| 7,170,464 | B2 | 1/2007 | Tang et al. |
| 7,176,838 | B1 | 2/2007 | Kinezos |
| 7,180,455 | B2 | 2/2007 | Oh et al. |
| 7,205,942 | B2 | 4/2007 | Wang et al. |
| 7,218,282 | B2 | 5/2007 | Humpfer et al. |
| 7,224,313 | B2 | 5/2007 | McKinzie et al. |
| 7,274,334 | B2 | 9/2007 | O'Riordan et al. |
| 7,283,097 | B2 | 10/2007 | Wen et al. |
| 7,289,064 | B2 | 10/2007 | Cheng |
| 7,292,200 | B2 | 11/2007 | Posluszny et al. |
| 7,330,153 | B2 | 2/2008 | Rentz |
| 7,333,067 | B2 | 2/2008 | Hung et al. |
| 7,339,528 | B2 | 3/2008 | Wang et al. |
| 7,340,286 | B2 | 3/2008 | Korva et al. |
| 7,345,634 | B2 | 3/2008 | Ozkar et al. |
| 7,352,326 | B2 | 4/2008 | Korva et al. |
| 7,358,902 | B2 | 4/2008 | Erkocevic |
| 7,385,556 | B2 | 6/2008 | Chung et al. |
| 7,391,378 | B2 | 6/2008 | Mikkola et al. |
| 7,423,592 | B2 | 9/2008 | Pros et al. |
| 7,439,929 | B2 | 10/2008 | Ozkar |
| 7,663,551 | B2 | 2/2010 | Nissinen et al. |
| 7,768,457 | B2 | 8/2010 | Pettus et al. |
| 7,825,863 | B2 | 11/2010 | Martiskainen et al. |
| 7,973,720 | B2 | 7/2011 | Sorvala |
| 8,098,202 | B2 | 1/2012 | Annamaa et al. |
| 9,325,060 | B2 | 4/2016 | Kalistaja |
| 2002/0019247 | A1 | 2/2002 | Egorov |
| 2002/0145569 | A1 | 10/2002 | Onaka et al. |
| 2002/0163470 | A1 | 11/2002 | Nagumo et al. |
| 2002/0196192 | A1 | 12/2002 | Nagumo et al. |
| 2003/0020659 | A1 | 1/2003 | Kushihi |
| 2003/0092420 | A1 | 5/2003 | Sugimoto et al. |
| 2003/0222827 | A1 | 12/2003 | Sung |
| 2004/0021607 | A1 | 2/2004 | Legay |
| 2004/0080457 | A1 | 4/2004 | Guo et al. |
| 2004/0090366 | A1 | 5/2004 | Wong et al. |
| 2004/0090378 | A1 | 5/2004 | Dai et al. |
| 2004/0090382 | A1 | 5/2004 | Kushihi et al. |
| 2004/0130493 | A1 | 7/2004 | Horita et al. |
| 2004/0178957 | A1 | 9/2004 | Chang et al. |

(56) References Cited

U.S. PATENT DOCUMENTS

| | | | |
|---|---|---|---|
| 2004/0212493 | A1 | 10/2004 | Stilp |
| 2005/0024268 | A1 | 2/2005 | McKinzie et al. |
| 2005/0024272 | A1 | 2/2005 | Ponce et al. |
| 2005/0057401 | A1 | 3/2005 | Yuanzhu |
| 2005/0078037 | A1 | 4/2005 | Leclerc et al. |
| 2005/0110692 | A1 | 5/2005 | Andersson |
| 2005/0243001 | A1 | 11/2005 | Miyata et al. |
| 2006/0071857 | A1 | 4/2006 | Pelzer |
| 2006/0145924 | A1 | 7/2006 | Chen et al. |
| 2006/0214857 | A1 | 9/2006 | Ollikainen |
| 2007/0013589 | A1 | 1/2007 | Park et al. |
| 2007/0109202 | A1 | 5/2007 | Vance |
| 2007/0115177 | A1 | 5/2007 | Kawahata et al. |
| 2007/0139277 | A1 | 6/2007 | Nissinen et al. |
| 2007/0152881 | A1 | 7/2007 | Chan |
| 2007/0152885 | A1 | 7/2007 | Sorvala |
| 2007/0152887 | A1 | 7/2007 | Castany et al. |
| 2007/0159399 | A1 | 7/2007 | Perunka et al. |
| 2007/0171131 | A1 | 7/2007 | Sorvala et al. |
| 2007/0241970 | A1 | 10/2007 | Thornell-Pers |
| 2007/0268190 | A1 | 11/2007 | Huynh |
| 2007/0273606 | A1 | 11/2007 | Mak et al. |
| 2007/0290938 | A1 | 12/2007 | Loyet |
| 2008/0007459 | A1 | 1/2008 | Koskiniemi et al. |
| 2008/0042903 | A1 | 2/2008 | Cheng |
| 2008/0088511 | A1 | 4/2008 | Sorvala et al. |
| 2008/0204328 | A1 | 8/2008 | Nissinen |
| 2008/0284661 | A1 | 11/2008 | He |
| 2008/0303729 | A1 | 12/2008 | Milosavljevic et al. |
| 2008/0316116 | A1 | 12/2008 | Hobson et al. |
| 2009/0135066 | A1 | 5/2009 | Raappana et al. |
| 2010/0176998 | A1 | 7/2010 | Sorvala |
| 2011/0012807 | A1* | 1/2011 | Sorvala ..... H01Q 1/2283 343/846 |

FOREIGN PATENT DOCUMENTS

| | | | |
|---|---|---|---|
| EP | 0376643 | A2 | 7/1990 |
| EP | 0759646 | A1 | 2/1997 |
| EP | 0766340 | A2 | 4/1997 |
| EP | 0766341 | A1 | 4/1997 |
| EP | 0831547 | A2 | 3/1998 |
| EP | 0942488 | A2 | 9/1999 |
| EP | 1003240 | A2 | 5/2000 |
| EP | 1052723 | A2 | 11/2000 |
| EP | 1063722 | A2 | 12/2000 |
| EP | 1102348 | A1 | 5/2001 |
| EP | 1113524 | A2 | 7/2001 |
| EP | 1128466 | A2 | 8/2001 |
| EP | 1139490 | A1 | 10/2001 |
| EP | 1146589 | A1 | 10/2001 |
| EP | 1151334 | A1 | 11/2001 |
| EP | 1162688 | A1 | 12/2001 |
| EP | 1248316 | A2 | 10/2002 |
| EP | 1267441 | A2 | 12/2002 |
| EP | 1294048 | A2 | 3/2003 |
| EP | 1294049 | A1 | 3/2003 |
| EP | 1351334 | A1 | 10/2003 |
| EP | 1361623 | A1 | 11/2003 |
| EP | 1400345 | A1 | 3/2004 |
| EP | 1406345 | A1 | 4/2004 |
| EP | 1414108 | A2 | 4/2004 |
| EP | 1432072 | A1 | 6/2004 |
| EP | 1437793 | A1 | 7/2004 |
| EP | 1453137 | A1 | 9/2004 |
| EP | 1469549 | A1 | 10/2004 |
| EP | 1482592 | A1 | 12/2004 |
| EP | 1498984 | A1 | 1/2005 |
| EP | 1544943 | A1 | 6/2005 |
| EP | 1791213 | A1 | 5/2007 |
| JP | H07249923 | A | 9/1995 |
| JP | H1028013 | A | 1/1998 |
| JP | H10209733 | A | 8/1998 |
| JP | H114117 | A | 1/1999 |
| JP | H1168456 | A | 3/1999 |
| JP | H11340726 | A | 12/1999 |
| JP | H11355033 | A | 12/1999 |
| JP | 2001217631 | A | 8/2001 |
| JP | 2002319811 | A | 10/2002 |
| JP | 20067027462 | | 12/2002 |
| JP | 2004112028 | A | 4/2004 |
| JP | 2004363859 | A | 12/2004 |
| JP | 2005005985 | A | 1/2005 |
| JP | 2005252661 | A | 9/2005 |
| WO | WO-9837592 | A1 | 8/1998 |
| WO | WO-0036700 | A1 | 6/2000 |
| WO | WO-0128035 | A1 | 4/2001 |
| WO | WO-0133665 | A1 | 5/2001 |
| WO | WO-0211236 | A1 | 2/2002 |
| WO | WO-02078123 | A1 | 10/2002 |
| WO | WO-2004070872 | A1 | 8/2004 |
| WO | WO-2004100313 | A1 | 11/2004 |
| WO | WO-2004112189 | A1 | 12/2004 |
| WO | WO-2005011055 | A1 | 2/2005 |
| WO | WO-2005018045 | A1 | 2/2005 |
| WO | WO-2005038981 | A1 | 4/2005 |
| WO | WO-2005055364 | A1 | 6/2005 |
| WO | WO-2006000631 | A1 | 1/2006 |
| WO | WO-2006000650 | A1 | 1/2006 |
| WO | WO-2006051160 | A1 | 5/2006 |
| WO | WO-2006084951 | A1 | 8/2006 |
| WO | WO-2006097567 | A1 | 9/2006 |
| WO | WO-2007000483 | A1 | 1/2007 |
| WO | WO-2007012697 | A1 | 2/2007 |
| WO | WO-2007039667 | A1 | 4/2007 |
| WO | WO-2007039668 | A1 | 4/2007 |
| WO | WO-2007042615 | A1 | 4/2007 |
| WO | WO-2007138157 | A1 | 12/2007 |

OTHER PUBLICATIONS

Jing, X., et al., "Compact Planar Monopole Antenna for Multi-Band Mobile Phones"; Microwave Conference Proceedings, 4.-7.12.2005. APMC 2005, Asia-Pacific Conference Proceedings, vol. 4.

Kivekas, et al., "Frequency-tunable internal antenna for mobile phones", Proceedings of 12emes Journees Internationales de Nice sur les Antennes, 12.sup.th Int 'l Symposium on Antennas (JINA 2002), vol. 2, 2002, Nice, France, s.53-56, tiivistelma.

Ryoson, at al., "A 13.56MHz RFID Device and Software for Mobile Systems", Micro Systems Network Co., 2004 IEEE, pp. 241-244.

Wang, H., "Dual-Resonance Monopole Antenna with Tuning Stubs"; IEEE Proceedings, Microwaves, Antennas & Propagation, vol. 153, No. 4, Aug. 2006; pp. 395-399.

Wang, K., et al.; "A Low-Profile Planar Monopole Antenna for Multiband Operation of Mobile Handsets"; IEEE Transactions on Antennas and Propagation, Jan. 2003, vol. 51, No. 1.

* cited by examiner

DIRECTIONAL ANTENNA APPARATUS AND METHODS

PRIORITY AND CROSS-REFERENCE TO RELATED APPLICATIONS

This application claims the benefit of priority to co-owned U.S. Provisional Patent Application Ser. No. 62/141,711 of the same title filed Apr. 1, 2015, the contents of which are incorporated herein by reference in its entirety.

This application is also related to co-owned U.S. patent application Ser. No. 13/215,021 filed Aug. 22, 2011 and entitled "ANTENNA, COMPONENT AND METHODS", now U.S. Pat. No. 8,390,522; which claims the benefit of priority to and is a continuation of co-owned U.S. patent application Ser. No. 12/871,841 filed Aug. 30, 2010 of the same title, now U.S. Pat. No. 8,004,470; which claims the benefit of priority to and is a continuation of co-owned U.S. patent application Ser. No. 11/648,429 filed Dec. 28, 2006 of the same title, now U.S. Pat. No. 7,786,938, each of the foregoing incorporated herein by reference in their entireties.

This application is also related to co-owned U.S. patent application Ser. No. 12/661,394 filed Mar. 15, 2010 and entitled "Chip Antenna Apparatus and Methods", now U.S. Pat. No. 7,973,720; which claims the benefit of priority to and is a continuation of co-owned U.S. patent application Ser. No. 11/648,431 filed Dec. 28, 2006 of the same title, now U.S. Pat. No. 7,679,565, each of the foregoing also incorporated herein by reference in their entireties.

COPYRIGHT

A portion of the disclosure contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. Technological Field

The present disclosure relates generally to antenna apparatus for use in electronic devices such as, for example, wireless or portable radio devices, and more particularly in one exemplary aspect to directional chip antenna apparatus and methods of use.

2. Description of Related Technology

In electronic devices, such as mobile phones, the antenna or antennas are often preferably placed inside the outer covering of the device. Moreover, due to the ever-increasing demands on (reducing) size, making these antenna(s) as small as possible is desired. An internal antenna usually has a planar structure such that it includes a radiating plane with a ground plane disposed below the radiating plane. There is also a variation in the context of a monopole antenna, in which the ground plane is not disposed below the radiating plane but rather, is disposed further off to one or more sides. In both instances, the size of the antenna can be reduced by manufacturing the radiating plane onto the surface of a dielectric chip, rather than making it air insulated.

Furthermore, due to an increasing demand for mobile data, portable communication devices often require operation at ever increasing data rates. To achieve these increasing data rates it may be of benefit to increase the transmission bandwidths over those that can be supported by a single carrier or channel. With the increasing popularity of long term evolution (LTE) capable mobile Internet devices and data extensive applications, bandwidth delivery becomes a challenging task for mobile operators. Furthermore, in mobile communication applications, radio wave communication by user equipment (UE) devices in urban environments may be subject to multipath interference.

Multiple-in multiple-out (MIMO) communications methods may be employed to provide for multiple communication paths between a given transmitter and a given receiver. Multiple communication paths (also referred to as spatial multiplexing) may provide for increased throughput due to improved spectral utilization, and/or for mitigation of multipath interference. Use of directional antenna devices may also provide for multipath interference mitigation. Such communications devices may employ multiple antenna components and may benefit from smaller sized antennas.

Accordingly, there is a salient need for an antenna apparatus and methods characterized by one or more of smaller size, improved directivity, reduced insertion losses, low complexity, and/or improved reliability that may be easily matched and/or tuned to a variety of mechanical environments and radio frequency (RF) operating characteristics.

SUMMARY

The present disclosure satisfies the foregoing needs by providing, inter alia, cost-efficient directional antenna apparatus and methods of use.

In a first aspect, antenna apparatus is disclosed. In one embodiment, the antenna apparatus includes a directional chip antenna apparatus. The directional chip antenna apparatus includes a chip component having a dielectric material characterized by a plurality of surfaces, such as with a conductive layer disposed on at least one of the plurality of surfaces; a ground plane component that includes a dielectric substrate having a conductive ground layer disposed thereupon; and a reflector component having a conductive surface. The ground plane includes a conductor free area, the chip component being disposed at least partially within the conductor free area. The plane of the conductive ground layer is arranged so as to be substantially perpendicular to the conductive surface of the reflector component. The conductive surface of the reflector component is configured to improve directivity for the directional chip antenna apparatus.

In a first variant, the ground plane includes a non-conductive portion disposed adjacent to the conductive ground layer, the non-conductive portion being distinct from the conductor free area.

In another variant, the reflector component is disposed immediately adjacent to the non-conductive portion.

In yet another variant, the improvement in directivity is characterized by an increased first cross-polar discrimination parameter for the antenna apparatus as compared with a second cross-polar discrimination parameter determined in the absence of the reflector component.

In yet another variant, the directional chip antenna apparatus further includes a feed structure configured to connect at least a portion of the conductive layer to a feed port of a radio frequency device; and a first ground structure configured to connect at least a portion of the conductive layer to the ground plane.

In yet another variant, the chip component includes a non-conductive slot disposed on the at least one of the plurality of surfaces, the non-conductive slot configured to partition the conductive layer into a first portion and a second portion of the directional chip antenna apparatus; and a feed structure is connected to the first portion and a first ground structure is connected to the first portion.

In yet another variant, a second ground structure is configured to connect the second portion to the ground plane; and the second portion is configured to be electromagnetically coupled to a feed port via the non-conductive slot.

In yet another variant, the dielectric material is characterized by a first and a second dimension, the conductor free area is characterized by a third and a fourth dimension; and the first dimension is smaller than the third dimension.

In yet another variant, the dielectric material is characterized by a longitudinal axis; and the reflector component is characterized by a second longitudinal axis configured to be disposed at an angle relative to the first longitudinal axis, the angle being greater than zero and smaller than ninety degrees.

In yet another variant, each of the first and the second dimensions are configured to be smaller than each of the third and the fourth dimensions, respectively.

In a second aspect, a wireless communications device is disclosed. In one embodiment, the mobile wireless device includes: a ground plane, a chip antenna component disposed thereupon, a reflector component disposed perpendicular to the ground plane, and a radio frequency electronics component that includes a feed port, the chip antenna component being connected to the feed port and to the ground plane.

In a variant, the chip component comprises a non-conductive slot disposed on a top surface, the non-conductive slot configured to partition the conductive layer into a first portion and a second portion with the feed port being connected to the first portion and a first ground structure being connected to the first portion.

In a third aspect, methods of using the aforementioned antenna apparatus are disclosed.

In a fourth aspect, methods of using the aforementioned wireless communications devices are disclosed.

In a fifth aspect, methods of tuning the aforementioned antenna apparatus are disclosed.

Further features of the present disclosure, its nature and various advantages will be more apparent from the accompanying drawings and the following detailed description.

BRIEF DESCRIPTION OF THE DRAWINGS

The features, objectives, and advantages of the disclosure will become more apparent from the detailed description set forth below when taken in conjunction with the drawings, wherein.

Figure 1A:
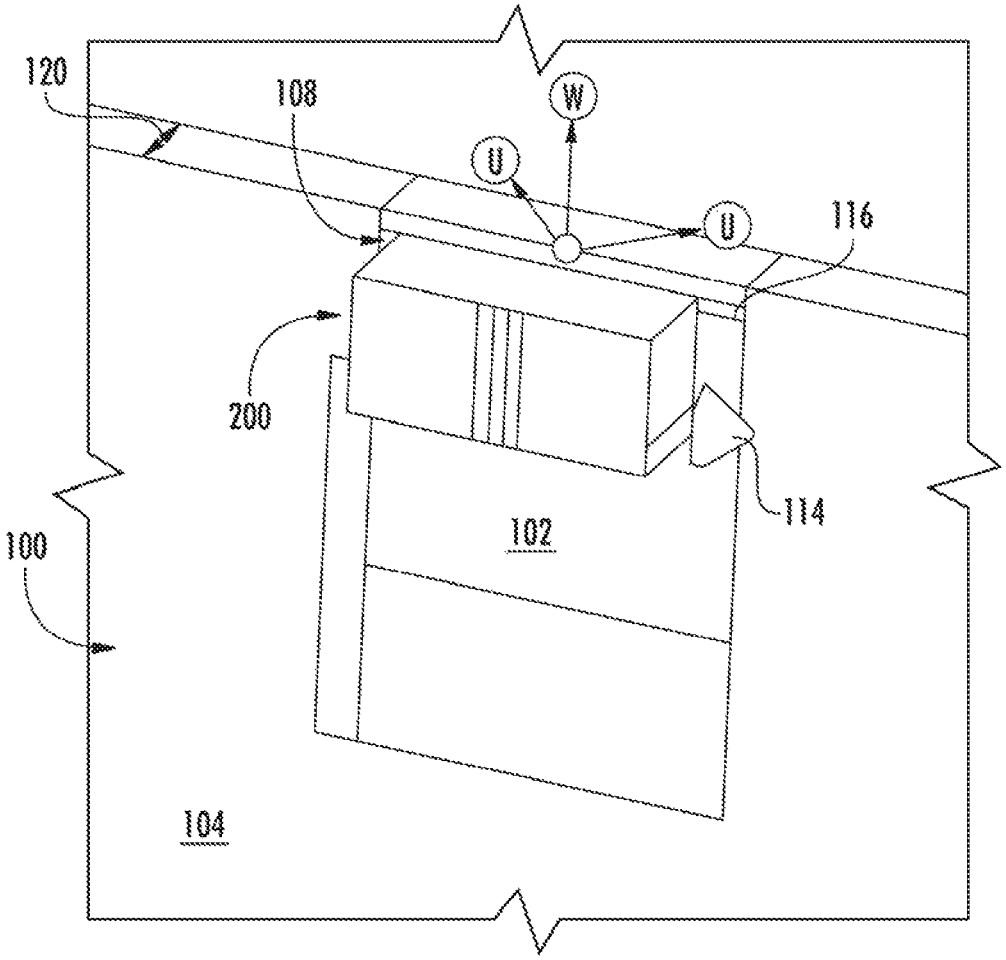
FIG. 1A is an isometric view illustrating one embodiment of a chip antenna apparatus configured in accordance with the principles of the present disclosure.

All Figures disclosed herein are ©Copyright 2015 Pulse Finland Oy. All rights reserved.

DETAILED DESCRIPTION

Reference is now made to the drawings, wherein like numerals refer to like parts throughout.

As used herein, the terms "antenna," "antenna system," "antenna assembly", and "multi-band antenna" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", "frequency band", and "frequency domain" refer without limitation to any frequency range for communicating signals. Such signals may be communicated pursuant to one or more standards or wireless air interfaces.

As used herein, the terms "portable device", "mobile device", "client device", and "end user device" include, but are not limited to, personal computers (PCs) and minicomputers, whether desktop, laptop, or otherwise, set-top boxes, personal digital assistants (PDAs), handheld computers, personal communicators, tablet computers, portable navigation aids, J2ME equipped devices, cellular telephones, smartphones, personal integrated communication or entertainment devices, or literally any other device capable of interchanging data with a network or another device.

Furthermore, as used herein, the terms "radiator," "radiating plane," and "radiating element" refer without limitation to an element that can function as part of a system that receives and/or transmits radio-frequency electromagnetic radiation; e.g., an antenna.

The terms "RF feed," "feed," "feed conductor," and "feed network" refer without limitation to any energy conductor and coupling element(s) that can transfer energy, transform impedance, enhance performance characteristics, and conform impedance properties between incoming/outgoing RF energy signals to that of one or more connective elements, such as for example a radiator.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, CDPD, satellite systems such as GPS, millimeter wave or microwave systems, optical, acoustic, and infrared (i.e., IrDA).

Overview

In one aspect, an improved directional antenna apparatus is disclosed. The directional antenna apparatus may include for example a chip antenna component mounted on ground plane. Moreover, the directional chip antenna apparatus may be electrically coupled with radio frequency (RF) electronics of a radio device via one or more feed structures and one or more ground structures. Individual ground structures are utilized in order to couple the chip antenna component to the ground plane. A suitable signal antenna feed methodology is utilized via, for example, a coaxial cable connected to a feed pad for the chip antenna component. Moreover, the directional chip antenna apparatus can be specifically configured for a given application. Additionally, one or more impedance matching components (e.g., capacitors, inductors, and/or lumped element components) may also be disposed proximate the chip antenna component depending on the specific configuration required.

A conductive layer is also advantageously removed from the portion of the ground plane proximate the chip antenna component in order to form a so-called conductor-free area. Dimensions of this conductor-free area below and/or near the chip antenna component may also be configured in accordance with specific application requirements to improve upon design considerations such as, for example, antenna resonant frequency, antenna operational bandwidth, antenna impedance within the operational bandwidth, efficiency, and/or various other antenna design parameters.

The chip antenna component may also include, in some embodiments, one or more non-conductive slot(s) (produced either by removing and/or omitting the chip antenna component metallization) in order to produce two or more antenna portions for the chip antenna component. Furthermore, in implementations where two antenna portions are utilized and where antenna isolation is a consideration, one antenna portion may be galvanically connected to the RF electronics feed via a feed structure, while the other antenna portion may be coupled electromagnetically to the RF feed via the non-conductive slot. The location and/or the dimensions/shape of the non-conductive slot may be further selected so as to, inter alia, tune the antenna center frequency to a desired operating frequency.

Moreover, the chip antenna component and the ground plane may be disposed onto or immediately adjacent to an RF reflector component. The reflector component includes, for example, a metal plate, a conductive radio device enclosure, conductive housing and/or other conductive surface(s). The distance between the ground plane and the reflector component and/or the positioning of the chip antenna component with respect to the foregoing may further be selected so as to produce a given directivity and beam width for the antenna response pattern. For example, the antenna ground plane may be disposed at a given angle with respect to an orthogonal plane for the reflector component, thereby enabling slanted polarization for the directional chip antenna apparatus.

Antenna methodology of the present disclosure further enables manufacturing of a compact antenna apparatus that may be matched and/or tuned for a variety of mechanical and/or frequency configurations. The antenna methodology of the present disclosure further provides for an antenna characterized by an improved directional response pattern. Finally, the directional antenna of the present disclosure may be employed in applications where omni-directional antenna elements may not be suitable. For example, the directional antenna apparatus may be utilized in MIMO radio frequency communications, spatial, and/or polarization multiplexing, and/or other suitable applications.

DETAILED DESCRIPTION OF EXEMPLARY EMBODIMENTS

Detailed descriptions of the various embodiments and variants of the apparatus and methods of the present disclosure are now provided. While primarily discussed in the context of implementation within a mobile wireless communications device, the various apparatus and methodologies discussed herein are not so limited. In fact, various embodiments of the apparatus and methodologies described herein are useful in any number of implementations, whether associated with mobile or fixed devices that can benefit from the grounding methodologies and apparatus described herein. Moreover, while described primarily in the context of a chip-based implementation, other non-chip based implementations are consistent with various aspects of the present disclosure.

FIG. 1A illustrates an exemplary chip antenna apparatus 100 configured in accordance with one implementation. The chip antenna apparatus includes a chip antenna component 200 that is, in the illustrated embodiment, disposed upon a surface of a ground plane 104. As discussed in more detail subsequently herein, the ground plane 104 includes a conductive material (e.g., copper, etc.). In some implementations, the conductive material will be disposed over a layer of a dielectric substrate. This dielectric substrate may include, for example, a non-conductive polymer (i.e., plastic), a glass reinforced epoxy (e.g., FR-4), and or any other known suitable materials. Moreover, in one exemplary embodiment, the dielectric layer thickness 120 may be selected from a range of between 0.5 mm and 5 mm, although other thicknesses may be chosen with proper adaptation.

The ground plane 104 will, in an exemplary embodiment, be connected to a ground port for the underlying radio frequency communications device (not shown). In the illustrated embodiment of FIG. 1A, the conductive material disposed immediately adjacent and below the chip antenna component 200 is removed from the ground plane 104 to form a so-called conductor-free area 102. Various methodologies may be employed for the removal of the conductive layer in the conductor-free area 102, such as via etching of the substrate, stripping of the substrate, etc. In some implementations where the ground plane 104 is fabricated by known metal deposition processes, the conductor-free area 102 may be masked-off so as to prevent deposition of the conductive material for the ground plane 104 within the conductor-free area 102. The dimensions and/or positioning of the conductor-free area 102 may be selected in order to tune the antenna resonant frequency; the antenna operational bandwidth, the antenna impedance within the operational bandwidth, the antenna efficiency, and/or other antenna design parameters. The chip antenna component 200 is further coupled to a feed structure 114 that will be connected to a feed port of the device RF electronics (not shown) via, for example, a coaxial cable and/or other conducting means. Moreover, the illustrated chip component 200 will also be connected to the ground plane at one or more locations such as, for example, grounding structures 116, 108.

Figure 1B:
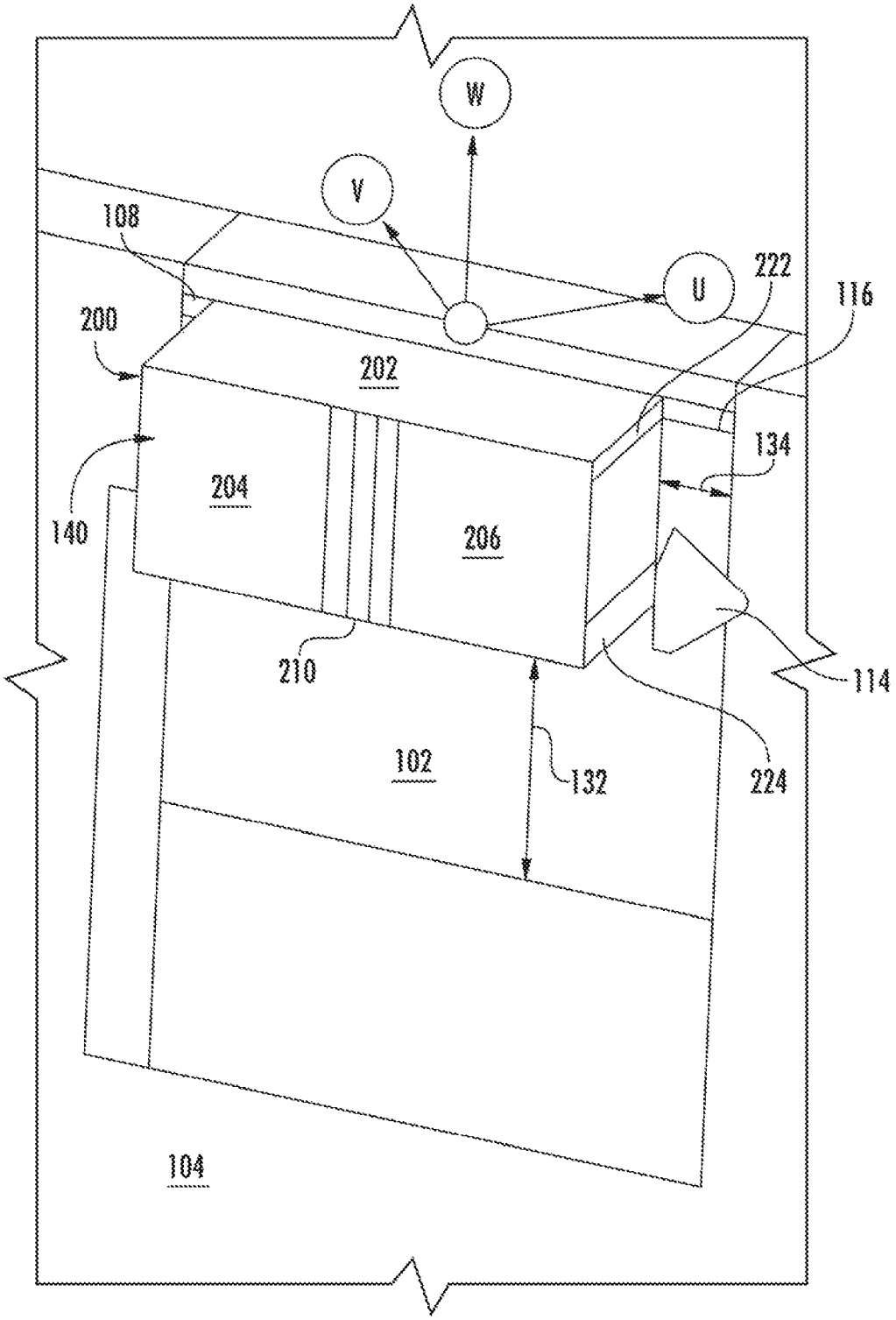
FIG. 1B is a detailed isometric view illustrating ground and feed configurations for the chip antenna apparatus of FIG. 1A configured in accordance with the principles of the present disclosure.

Referring now to FIG. 1B, various structures associated with the chip antenna component 200 of FIG. 1A will now be discussed in additional detail. The chip antenna component 200 includes a conductive layer 140 disposed on a surface of the chip substrate 202. In one or more implementations, the substrate material will include a ceramic; a ceramic polymer composite (e.g., using a high-permittivity Barium Titanate (BaTiO3) ceramic powder mixed with polydimethylsiloxane (PDMS) polymer); FR-4; a polymer (e.g., polyimide, PEN, PET, PC, etc.); alumina; glass and/or other suitable dielectric materials. In some implementations, the conductive layer 140 may comprise silver, tin, aluminum, copper, gold, and/or any other suitable conductive material(s). Moreover, in certain implementations conductive fluid (e.g., Ag ink, etc.) deposition processes such as that described in co-owned and co-pending U.S. patent application Ser. No. 14/620,108 filed Feb. 11, 2015 and entitled "Methods and Apparatus for Conductive Element Deposition and Formation", the contents of which are incorporated herein by reference in its entirety, may be readily utilized. In some implementations, the chip antenna component 200 may also optionally include one or more non-conductive slot(s) 210. In the illustrated embodiment, a single non-conductive slot 210 is shown that extends across the top surface of the chip component 200 thereby producing two antenna portions 204, 206. These antenna portions 204, 206 are, in the illustrated embodiment, not galvanically connected to one another, although it is appreciated that in other antenna apparatus embodiments, it may be desirable for a galvanic connection between the antenna portions. Specifically, in applications in which isolation is an important design consideration, it is recognized that non-galvanic connections between antenna portions 204, 206 have been found to be beneficial. The non-conductive slot 210 may be produced by, for example, the removal of chip antenna metallization and/or the omission of chip antenna metallization (e.g., using masking) during antenna fabrication.

One antenna portion (e.g., 206 in FIG. 1B) is galvanically connected to the RF electronics feed via the feed structure 114, 224. The feed structure 114, 224 will, in an exemplary embodiment, include a strip of conductive material 224 disposed on a vertical side of the chip substrate 202. The other antenna portion (e.g., 204) is coupled electromagnetically to the RF feed via the slot 210. The location and/or dimensions of the non-conductive slot 210 are selected so as to tune antenna resonant frequency and/or impedance bandwidth. By way of illustration, a wider non-conductive slot 210 corresponds to a higher resonant frequency, while a narrower slot corresponds to a lower resonant frequency. In some implementations, one or more impedance matching components (e.g. discrete component(s) and/or lumped element(s)) are disposed onto (or adjacent to) the ground plane proximate to the antenna feed port 114.

The antenna portion 206 is, in the illustrated embodiment, connected to the ground plane 104 via grounding structures 116, 222. The ground structure 116, 222 may also include, in an exemplary embodiment, a strip of conductive material 222 disposed on a vertical side of the chip substrate 202. The ground structure 116 may also include, in an exemplary embodiment, a strip of conductive material 222 configured to galvanically connect the antenna component 200 to the conductive surface of the ground plane 104. The antenna portion 204 is also connected to the ground plane 104 via grounding structure 108 (and grounding structure 214 shown in FIG. 2B). The ground structure 108 may also include, in an exemplary embodiment, a strip of conductive material 214 configured to galvanically connect the antenna component 200 to the conductive surface of the ground plane 104. Moreover, and as shown in FIG. 1B, the conductive portion of the ground plane below the chip component 200 and immediately proximate to it is removed, thereby forming a conductor-free area 102. Dimensions of the conductor free area 102 and the distance from the chip component 200 to the ground plane 104 conductive surface (e.g., dimensions denoted by arrows 134, 132 in FIG. 1B) are selected so as to obtain a given resonant frequency for the antenna apparatus shown in, for example, FIGS. 1A-1B. While a specific ground and feed structure has been illustrated with respect to FIGS. 1A-1B, it is readily appreciated that other configurations may be utilized in other antenna configurations including more feed structures and/or more or less ground structures.

Figure 2A:
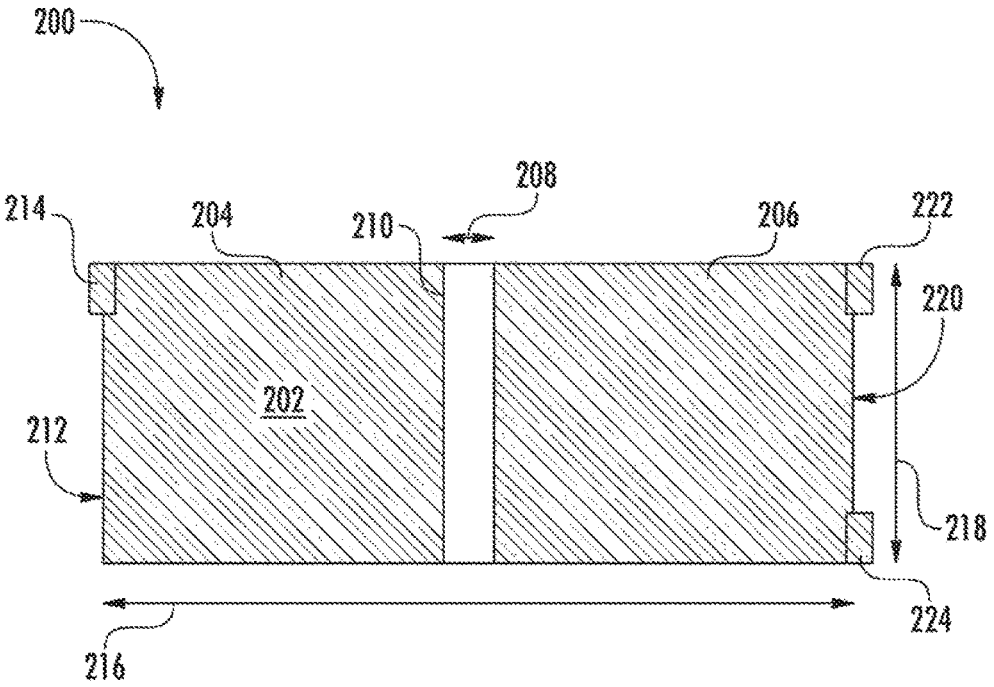
FIGS. 2A-2C are detailed views of a chip antenna component for use with, for example, the chip antenna apparatus of FIGS. 1A-1B configured in accordance with the principles of the present disclosure.
Figure 2B:
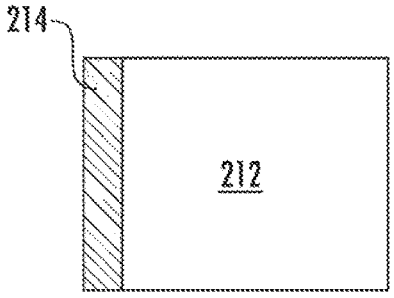
Figure 2C:
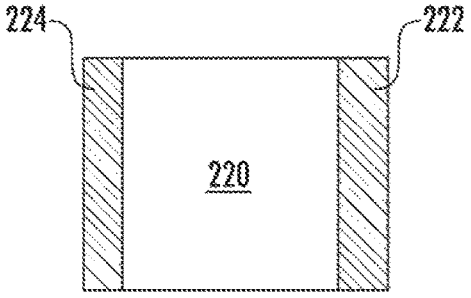

FIGS. 2A-2C illustrate the chip antenna component 200 for use with, for example, the antenna apparatus of FIG. 1A, in accordance with one implementation. FIG. 2A is a top plan view of the chip antenna component 200. As discussed previously herein, chip antenna component 200 is manufactured from a dielectric substrate manufactured from, for example, a ceramic; a ceramic polymer composite (e.g., using a high-permittivity Barium Titanate (BaTiO3) ceramic powder mixed with polydimethylsiloxane (PDMS) polymer); FR-4; a polymer (e.g., polyimide, PEN, PET, PC, etc.); alumina; glass and/or other suitable dielectric materials. A conductive layer is disposed onto a top surface of the substrate. For example, in some implementations, the conductive layer may comprise silver, tin, aluminum, copper, gold, or a combination thereof and/or another conductive material such as those described in co-owned and co-pending U.S. patent application Ser. No. 14/620,108 filed Feb. 11, 2015 and entitled "Methods and Apparatus for Conductive Element Deposition and Formation", the contents of which were previously incorporated herein by reference in its entirety. Similar to that discussed above with respect to FIG. 1B, the chip antenna component 200 may also include a non-conductive slot 210. The non-conductive slot 210 extends across the top surface of the chip component 200 thereby producing two antenna portions, 204, 206. These antenna portions 204, 206 are, in the illustrated embodiment, not galvanically connected to one another, although it is appreciated that in other directional antenna apparatus embodiments, it may be desirable for a galvanic connection between the antenna portions, specifically where antenna isolation is not a strong design consideration. The non-conductive slot 210 may be produced by removing (e.g. by etching) the conductive layer that forms antenna portions 204, 206, and/or by omitting (e.g., using masking) the chip antenna metallization during component fabrication. The location and/or dimensions (e.g., width 208) of the non-conductive slot are selected so to tune the antenna resonant frequency and/or the impedance bandwidth of the component. By way of an illustration, a wider slot (i.e., a larger width 208) may correspond to a higher resonant frequency, while a narrower slot corresponds to a lower resonant frequency. Moreover, in one or more implementations (not shown) the slot 210 is disposed diagonally along the top surface of the component 200, or alternatively may include one or more turns (e.g., a "zig-zag" pattern and/or one or more curves). Antenna portion 206 is galvanically connected to the RF electronics feed via the feed structure 224. The feed structure 224 is positioned along a vertical side 220 of the chip component as shown in more detail in FIG. 2C. Moreover, the antenna portion 206 is also connected to ground via a conductive ground structure 222. Antenna portion 204 is also connected to the ground plane via a ground structure 214. The ground structure 214 includes, in an exemplary embodiment, a strip of conductive material disposed on a vertical side 212 of the chip component 200.

Figure 3A:
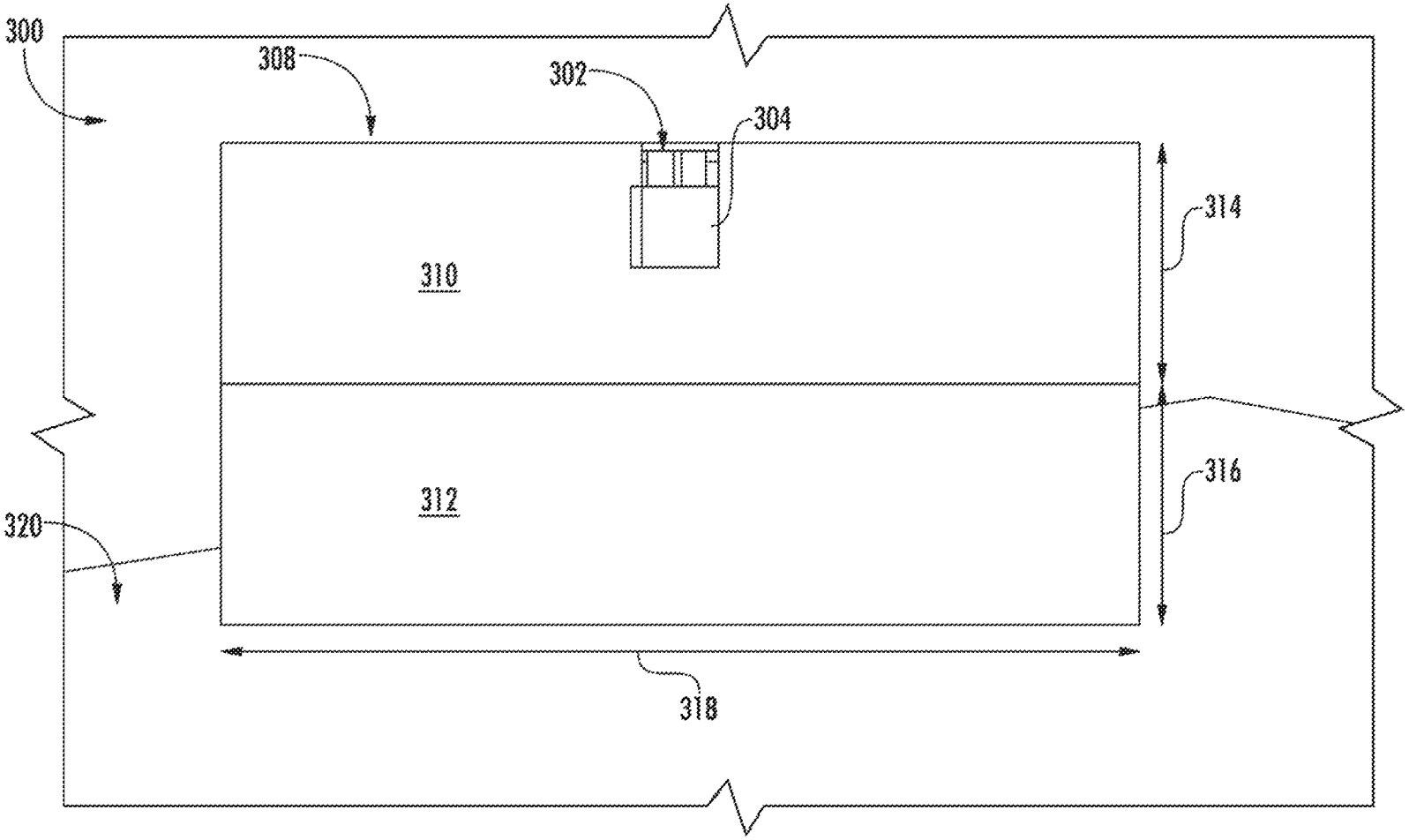
FIGS. 3A-3B are isometric views of a chip antenna apparatus, such as that shown in FIGS. 1A-1B, disposed atop a reflector plane thereby providing for transmission and/or reception directivity characteristics in accordance with the principles of the present disclosure.
Figure 3B:
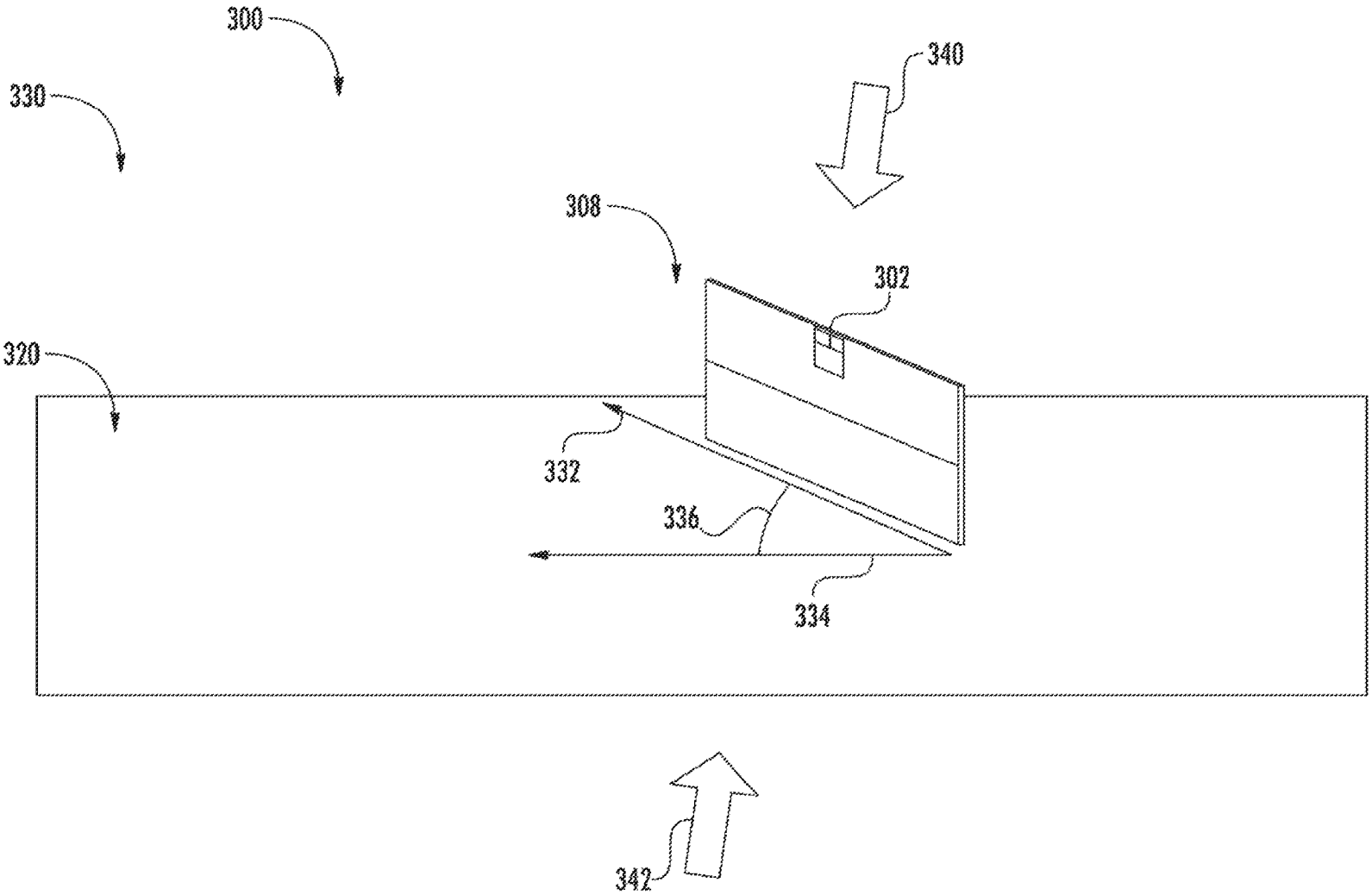

Referring now to FIGS. 3A-3B, one exemplary configuration for a directional chip antenna apparatus is illustrated. As illustrated, the antenna apparatus 300 of FIGS. 3A-3B includes a chip antenna assembly 308 disposed atop a reflector component 320. In one or more implementations, the reflector component 320 is manufactured from a conductive material (e.g., copper, silver, tin, aluminum, a combination thereof and/or another conductive material). The reflector component also may optionally include a plate of dielectric material (e.g., FR-4 and/or other suitable dielectric material) that is configured to support the conductive layer. The chip antenna assembly 308 also includes a chip component 302 disposed on top of a ground plane 310. In some implementations, the chip component 302 may comprise the chip antenna component 200 shown and described above with respect to FIGS. 1A-2C. The ground plane 310 is manufactured from, for example, a conductive layer of material disposed atop a dielectric substrate as described above with respect to ground plane 104 of FIG. 1A. A portion of the area 304 beneath and/or proximate the chip component 302 in FIG. 3A may be removed/absent as shown in FIG. 3A.

As shown, a non-conductive area 312 of ground plane 310 is utilized to elevate the ground plane 310 above the reflector component 320. The distance 316 between the ground plane 310 and the reflector component 320 is advantageously selected in order to obtain target directional properties for the antenna 300 radiation pattern. For example, in instances in which the distance 316 between the ground plane and the reflector is smaller, a narrower beam and/or a more directional nature for the antenna apparatus is achieved. By way of an illustration, a conductive layer (e.g., silver, copper, etc.) is disposed on a top portion of a dielectric substrate (e.g., FR-4) to produce the ground plane 310. The bottom portion 312 of the substrate may remain without the conductive layer and be used to space the ground plane 310 from the reflector plane 320 at a target distance 316. The dimensions of the ground plane (e.g., 314, 318) are used to obtain target antenna performance parameters including, for example, peak gain and half-power beam width for the antenna. In one exemplary embodiment, the plane of the assembly 308 is configured so as to be substantially perpendicular with (e.g., within ±5°) the plane of the reflector component 320.

FIG. 3B illustrates an exemplary spatial configuration for the chip antenna assembly 308 and the reflector component 320 configured to obtain an antenna apparatus characterized by a slanted polarization, in accordance with one or more implementations. The antenna configuration 330 employs a chip antenna assembly 308 disposed atop a reflector component 320. Longitudinal axis 332 of the assembly 308 forms an angle 336 with respect to a longitudinal axis 334 of the reflector component 320. In the illustrated embodiment, angle 336 is configured for a 45° slanted polarization. While a 45° slanted polarization is illustrated, it is appreciated that the angle 336 may be adjusted so as to obtain any desired level of slanted polarization. For example, vertical or horizontal polarizations can be easily achieved via proper adaptation of the reflector plane/chip antenna assembly orientations. Moreover, multi-antenna MIMO schemes (e.g., 2×2, 4×4, 8×8, etc.) may also be readily realized by adding additional chip antenna assemblies (i.e., chip component plus ground plane) on top of either: (1) the same reflector 320; or (2) multiple reflectors (not shown).

The reflector component 320 in FIGS. 3A-3B may be utilized in order to obtain target directivity characteristics for the chip antenna apparatus 308. By way of an illustration, radio waves (shown by arrow 342 in FIG. 3B) arriving at the chip antenna component 302 from beneath the reflector component 320 may be reflected away so that their contribution to the signal received by the chip antenna apparatus 308 may be reduced compared to antenna operation in the absence of the reflector component 320. Radio waves (shown by arrow 340 in FIG. 3B) arriving at the chip antenna apparatus 308 from above may be received by the chip antenna component 302 in one of two ways: (1) direct path; and (2) a reflected path where a portion of the RF energy reaching the chip antenna may comprise waves reflected by the reflector component 320. Individual wave components (e.g., direct path, reflected path) may be characterized by a respective phase. Distance 314, 316 may be used to configure phase composition of the waves arriving at the antenna component and/or to obtain target antenna directivity pattern.

Figure 4:
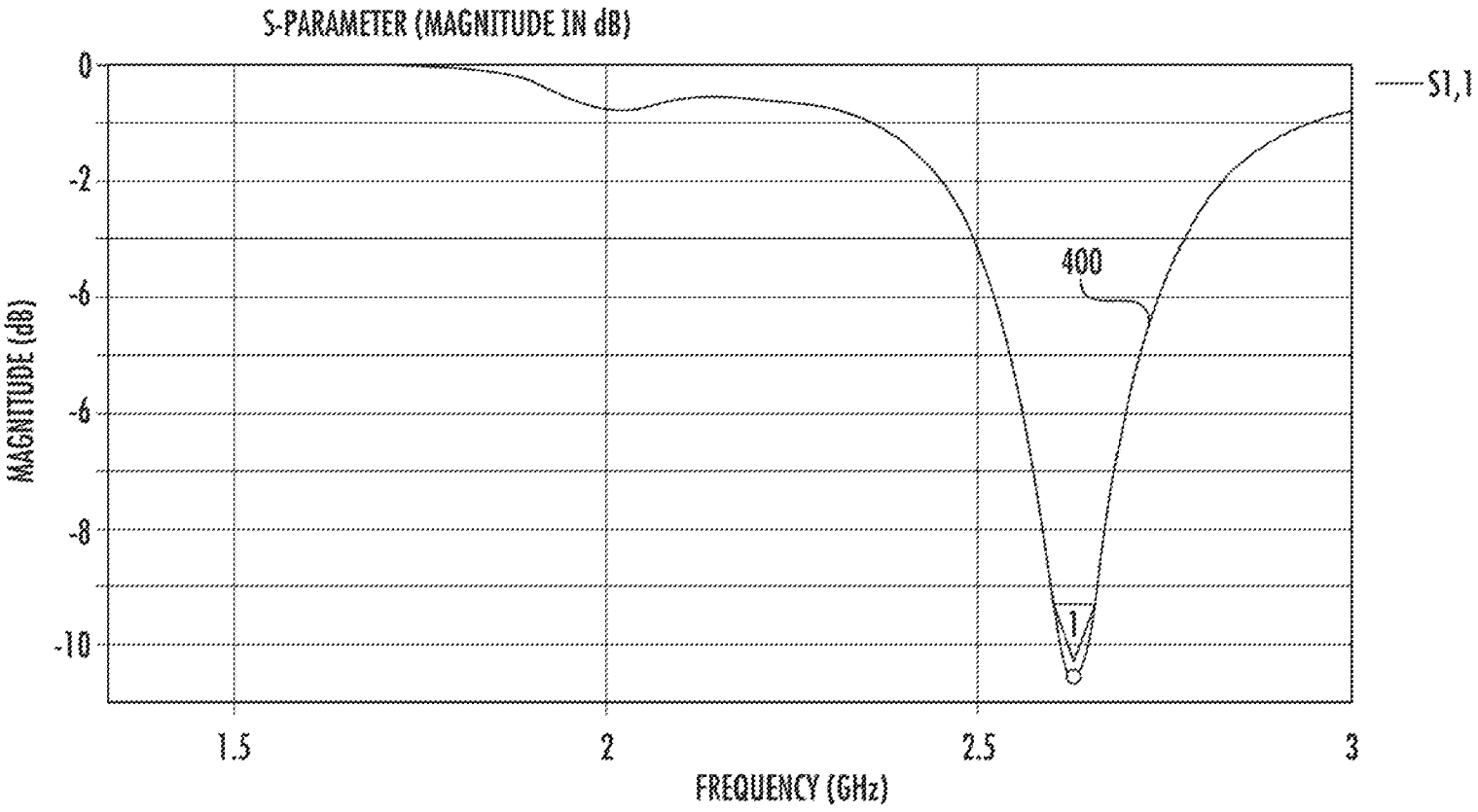
FIG. 4 is a plot illustrating return loss as a function of frequency for the directional chip antenna apparatus of FIGS. 3A-3B in accordance with the principles of the present disclosure.

Referring now to FIG. 4, data related to the frequency response curve 400 of a directional chip antenna apparatus configured in accordance with one implementation is shown and described in detail. Specifically, the antenna response with respect to FIG. 4 is configured to operate in a frequency band centered around 2.6 GHz and provides for more than 11 dB of response at 2.6 GHz.

Figure 5A:
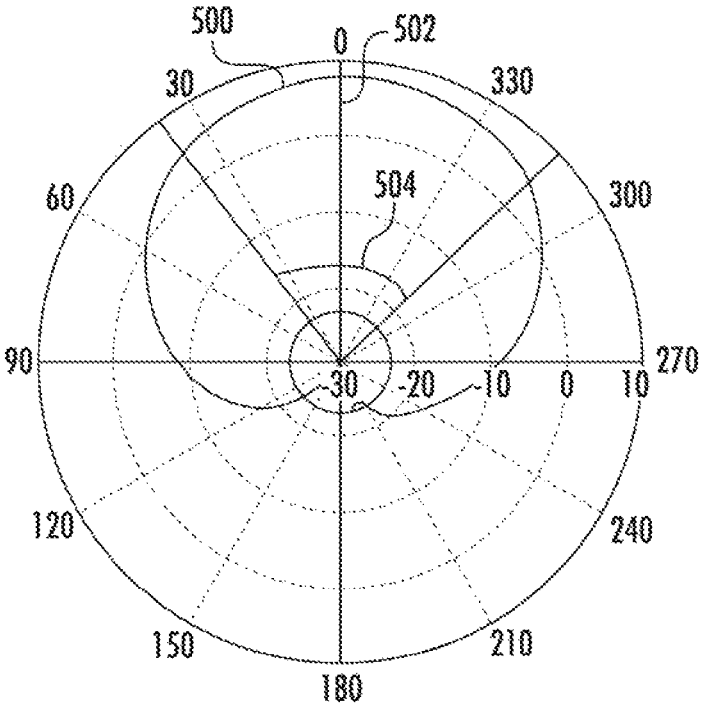
FIG. 5A is a plot illustrating the co-polar two-dimensional radiation pattern for the directional chip antenna apparatus of FIGS. 3A-3B in accordance with the principles of the present disclosure.
Figure 5B:
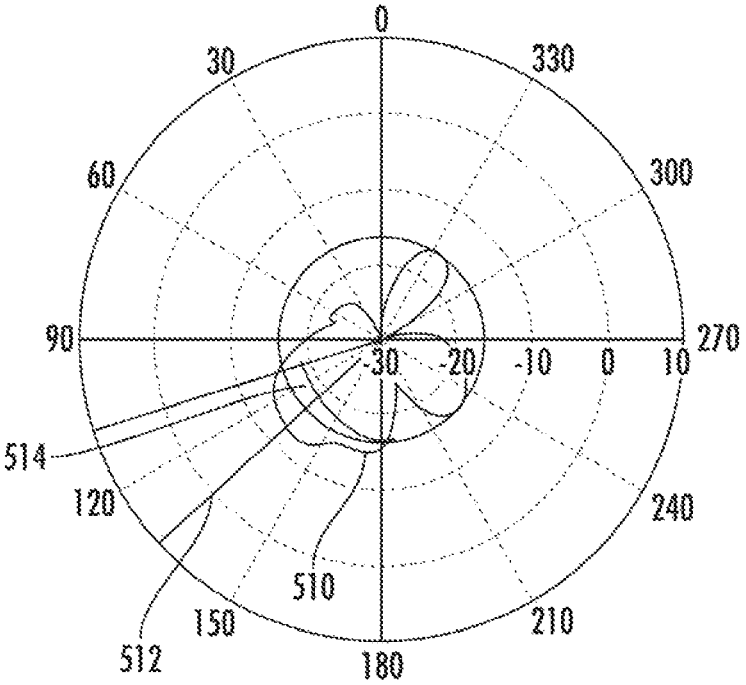
FIG. 5B is a plot illustrating the cross-polar two-dimensional radiation pattern for the directional chip antenna apparatus of FIGS. 3A-3B in accordance with the principles of the present disclosure.

FIGS. 5A-5B illustrate two-dimensional radiation patterns of a directional chip antenna apparatus configured in accordance with one implementation. As is well understood in radio frequency antenna design, the term radiation pattern (or antenna pattern or far-field pattern) may be used to refer to the directional (angular) dependence of the strength of the radio waves emitted by the antenna or received from another source. FIG. 5A illustrates an exemplary co-polar response, while FIG. 5B illustrates an exemplary cross-polar response. A co-polar radiation pattern of an antenna is measured with a suitably polarized probe antenna which is sensitive to the target direction of polarization. A cross-polarized radiation pattern is measured for linear polarization by rotating the probe antenna by $\pi/2$ around the line joining the two antennas, or for circular/elliptical polarization by changing the probe antenna helicity sign.

The co-polarization pattern denoted by curve 500 in FIG. 5A indicates main lobe sensitivity of 7.55 dB at an angle of 359° (denoted 502). Moreover, the co-polarization pattern also indicates a 3-dB beam width of 83.3° (denoted by 504 in FIG. 5A); with a side lobe level of −30.8 dB.

The cross-polarization pattern shown by curve 510 in FIG. 5B indicates a back lobe level of −25 dB thereby producing 32.6 dB of front-to-back directional discrimination. The curve 510 in FIG. 5B indicates −13 dBi main lobe magnitude at an orientation of 132° (shown by line 512) thus providing 20.6 dB cross-polar discrimination (XPD) between co-polar and cross-polar main beams. Curve 514 in FIG. 5B denotes 3 dB beam width of 71.6° for the cross-polar beam.

Figure 6A:
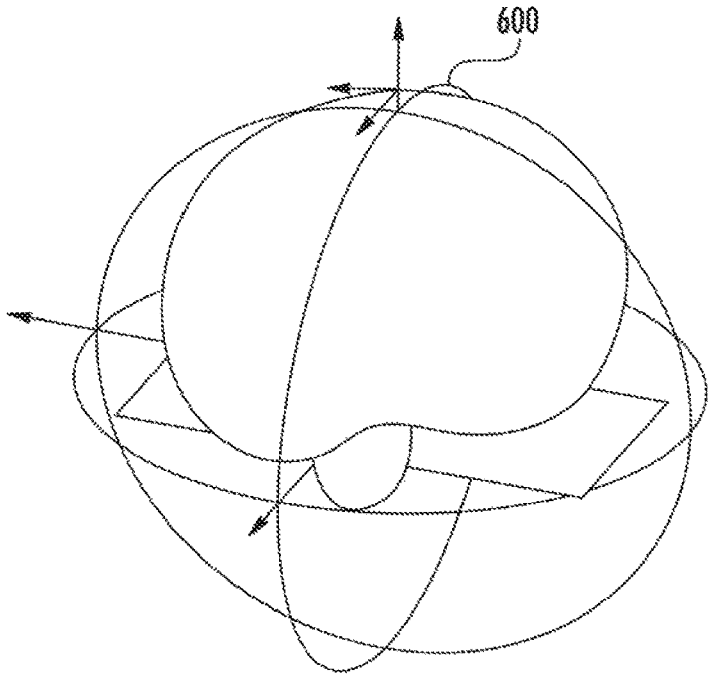
FIG. 6A is a plot illustrating the co-polar three-dimensional radiation pattern for the directional chip antenna apparatus of FIGS. 3A-3B in accordance with the principles of the present disclosure.
Figure 6B:
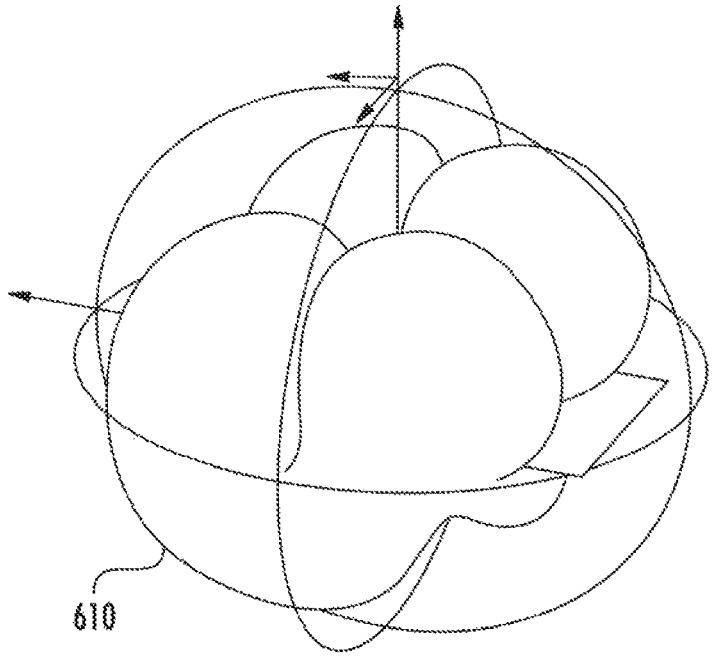
FIG. 6B is a plot illustrating the cross-polar three-dimensional radiation pattern for the directional chip antenna apparatus of FIGS. 3A-3B in accordance with the principles of the present disclosure.

FIGS. 6A-6B illustrate, respectively, three-dimensional co-polarized and cross-polarized radiation patterns of a directional chip antenna apparatus configured in accordance with one implementation. The co-polarized pattern 600 of FIG. 6A illustrates a main beam at about 0° orientation in a three-dimensional space. The cross-polarized pattern 610 of FIG. 6B illustrates a back beam in a three-dimensional space.

It will be recognized that while certain aspects of the disclosure are described in terms of a specific sequence of steps of a method, these descriptions are only illustrative of the broader methods of the present disclosure, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure as discussed and claimed herein.

While the above detailed description has shown, described, and pointed out novel features of the present disclosure as applied to various embodiments, it will be understood that various omissions, substitutions, and changes in the form and details of the device or process illustrated may be made by those skilled in the art without departing from the contents of the present disclosure. The foregoing description is of the best mode presently contemplated of carrying out embodiments of the present disclosure. This description is in no way meant to be limiting, but rather should be taken as illustrative of the general principles of the present disclosure. The scope of the present disclosure should be determined with reference to the claims.

What is claimed is:

1. A wireless communications device, comprising:

a radio frequency (RF) component system comprising an antenna feed port; and a directional chip antenna apparatus, comprising:

a chip component comprising a dielectric material characterized by a plurality of surfaces with a conductive layer disposed on at least one of the plurality of surfaces;

a ground plane component comprising a dielectric substrate having a conductive ground layer disposed thereupon; and a reflector component comprising a conductive surface; wherein:

the ground plane comprises a conductor free area, the chip component being disposed at least partially within the conductor free area;

a plane of the conductive ground layer is arranged so as to be substantially perpendicular to the conductive surface of the reflector component; and the conductive surface of the reflector component is configured to improve a directivity for the directional chip antenna apparatus.

2. The wireless communications device of claim 1, wherein the improvement of the directivity for the directional chip antenna apparatus comprises an increased first cross-polar discrimination parameter of the directional chip antenna apparatus as compared with a second cross-polar discrimination parameter determined in an absence of the reflector component.

3. The wireless communications device of claim 1, wherein the plurality of surfaces comprises at least two conductive surfaces separate from one another by a gap;

wherein the gap is configured to generate a resonant frequency of greater than 2.5 GHz for the directional chip antenna apparatus.

4. A directional chip antenna apparatus, comprising:

a chip component comprising a dielectric material characterized by a plurality of surfaces with a conductive layer disposed on at least one of the plurality of surfaces;

a ground plane component comprising a dielectric substrate having a conductive ground layer disposed thereupon; and a reflector component comprising a conductive surface; wherein:

the ground plane comprises a conductor-free area and a non-conductive portion disposed adjacent to the conductive ground layer, the non-conductive portion being distinct from the conductor-free area, the reflector component is disposed immediately adjacent to the non-conductive portion, the chip component being disposed at least partially within the conductor-free area;

a plane of the conductive ground layer is arranged so as to be substantially perpendicular to a plane of the conductive surface of the reflector component; and the conductive surface of the reflector component is configured to improve a directivity for the directional chip antenna apparatus, the improvement in the directivity comprising an increased first cross-polar discrimination parameter of the directional chip antenna apparatus as compared with a second cross-polar discrimination parameter determined in an absence of the reflector component.

5. The apparatus of claim 4, further comprising:

a feed structure configured to connect at least a portion of the conductive layer to a feed port of a radio frequency device; and a first ground structure configured to connect at least a portion of the conductive layer to the ground plane.

6. The apparatus of claim 4, wherein:

the chip component further comprises a non-conductive slot disposed on the at least one of the plurality of surfaces, the non-conductive slot configured to partition the conductive layer into a first portion and a second portion of the directional chip antenna apparatus; and a feed structure and a first ground structure are connected to the first portion of the directional chip antenna apparatus.

7. The apparatus of claim 6, further comprising a second ground structure configured to connect the second portion of the directional chip antenna apparatus to the ground plane; and wherein the second portion of the directional chip antenna apparatus is configured to be electromagnetically coupled to a feed port via the non-conductive slot.

8. The apparatus of claim 4, wherein:

the dielectric material is characterized by a first and a second dimension, the conductor-free area is characterized by a third and a fourth dimension; and the first dimension is smaller than the third dimension.

9. The apparatus of claim 8, wherein each of the first and the second dimensions are configured to be smaller than each of the third and the fourth dimensions, respectively.

10. The apparatus of claim 4, wherein:

the dielectric material is characterized by a longitudinal axis; and the reflector component is characterized by a second longitudinal axis configured to be disposed at an angle relative to the first longitudinal axis, the angle being greater than zero and smaller than ninety degrees.

11. The apparatus of claim 4, wherein the chip component further comprises a non-conductive gap disposed between the conductive layer and another conductive layer, each of the conductive layer and the another conductive layer being disposed on the at least one of the plurality of surfaces.

12. The apparatus of claim 11, wherein the non-conductive gap comprises a width configured to tune an antenna resonant frequency and an impedance bandwidth of the chip component.

13. A directional chip antenna apparatus, comprising:

a three-dimensional chip component comprising a dielectric material characterized by a plurality of surfaces;

a ground plane component comprising a dielectric substrate having a planar conductive ground layer disposed thereupon and a conductor-free area, the chip component being disposed at least partially within the conductor-free area; and a reflector component comprising a planar conductive surface configured to improve a directivity for the directional chip antenna apparatus, the planar conductive ground layer of the ground plane being arranged so as to be substantially perpendicular to the planar conductive surface of the reflector component;

wherein:

a first surface of the plurality of surfaces is substantially parallel with the planar conductive ground layer disposed upon the ground plane;

a second and a third surface of the plurality of surfaces is substantially orthogonal with the planar conductive ground layer disposed upon the ground plane; and the first surface of the plurality of surfaces is substantially orthogonal with the planar conductive surface of the reflector component;

the first surface comprises at least two conductive surfaces disposed thereon, the at least two conductive surfaces being separated from one another by at least one gap; and the at least one gap is sized so as to generate a resonant frequency for the directional antenna apparatus of greater than 2.5 GHz.

14. The apparatus of claim 13, wherein the ground plane component comprises a non-conductive area, the non-conductive area disposed between the three-dimensional chip component and the reflector component.

15. The apparatus of claim 14, wherein the non-conductive area of the ground plane component is sized so as to enable a target directional property for the directional chip antenna apparatus.

16. The apparatus of claim 15, wherein the target directional property comprises a beam width of approximately 70°.

17. The apparatus of claim 13, wherein the second surface comprises a first grounding structure, the first grounding structure configured to be galvanically coupled to the planar conductive ground layer of the ground plane component.

18. The apparatus of claim 17, wherein the third surface comprises:

a second grounding structure, the second grounding structure configured to be galvanically coupled to the planar conductive ground layer of the ground plane component; and a feed structure coupled to an antenna feed port.

19. The apparatus of claim 18, wherein the second surface and the third surface are disposed substantially parallel to each other.

20. The apparatus of claim 13, wherein the dielectric material is disposed atop the reflector component such that a longitudinal axis of the dielectric material is configured to form a non-zero angle with respect to a longitudinal axis of the reflector component, the angle enabling a slanted polarization for the directional chip antenna apparatus.

* * * * *